US012372279B2

(12) United States Patent
Yoshii et al.

(10) Patent No.: US 12,372,279 B2
(45) Date of Patent: Jul. 29, 2025

(54) REFRIGERATION MACHINE

(71) Applicant: MITSUBISHI HEAVY INDUSTRIES THERMAL SYSTEMS, LTD., Tokyo (JP)

(72) Inventors: Taichi Yoshii, Tokyo (JP); Tatsuo Ishiguro, Tokyo (JP); Yoshie Togano, Tokyo (JP); Naoya Miyoshi, Tokyo (JP); Wenping Wu, Tokyo (JP)

(73) Assignee: MITSUBISHI HEAVY INDUSTRIES THERMAL SYSTEMS, LTD., Tokyo (JP)

( * ) Notice: Subject to any disclaimer, the term of this patent is extended or adjusted under 35 U.S.C. 154(b) by 170 days.

(21) Appl. No.: 18/038,666

(22) PCT Filed: Nov. 16, 2021

(86) PCT No.: PCT/JP2021/042020
§ 371 (c)(1),
(2) Date: May 24, 2023

(87) PCT Pub. No.: WO2022/113815
PCT Pub. Date: Jun. 2, 2022

(65) Prior Publication Data

US 2024/0035719 A1 Feb. 1, 2024

(30) Foreign Application Priority Data

Nov. 27, 2020 (JP) ..... 2020-197042

(51) Int. Cl.
*F25B 41/385* (2021.01)
*F25B 1/10* (2006.01)
(Continued)

(52) U.S. Cl.
CPC ..... *F25B 39/00* (2013.01); *F25B 1/10* (2013.01); *F25B 41/385* (2021.01); *F25B 39/02* (2013.01);
(Continued)

(58) Field of Classification Search
CPC ..... F25B 39/00; F25B 39/02; F25B 39/024; F25B 39/028; F25B 41/385; F25B 41/39;
(Continued)

(56) References Cited

U.S. PATENT DOCUMENTS 5,351,488 A * 10/1994 Sorensen ..... F03G 6/003 417/208
2008/0148767 A1 6/2008 De Larminat et al.
(Continued)

FOREIGN PATENT DOCUMENTS

CN 101191683 A 6/2008
JP 62-162868 A 7/1987
(Continued)

OTHER PUBLICATIONS

International Search Report and Written Opinion of the International Searching Authority for International Application No. PCT/JP2021/042020, dated Dec. 21, 2021, with English translation.

*Primary Examiner* — Miguel A Diaz
(74) *Attorney, Agent, or Firm* — Birch, Stewart, Kolasch & Birch, LLP

(57) ABSTRACT

This refrigeration machine comprises a compressor that compresses a refrigerant, a condenser that condenses the refrigerant which has been compressed by the compressor, an expander that expands the refrigerant which has been condensed by the condenser, a liquid film type evaporator that evaporates the refrigerant which has been expanded by the expander, and an eductor that generates flow speed difference and pressure difference in the refrigerant which has been expanded by the expander and suctions refrigerant stored in the evaporator.

9 Claims, 6 Drawing Sheets

(51) Int. Cl.
*F25B 39/00* (2006.01)
*F25B 39/02* (2006.01)

(52) U.S. Cl.
CPC ..... *F25B 2339/0242* (2013.01); *F25B 2341/0011* (2013.01); *F25B 2400/13* (2013.01); *F25B 2400/23* (2013.01)

(58) Field of Classification Search
CPC ..... F25B 1/10; F25B 2339/0242; F25B 2339/024; F25B 2339/021; F25B 9/08; F25B 2341/001; F25B 2341/0011; F25B 2341/0013; F25B 2400/0407; F25B 2400/13; F25B 2400/16; F25B 2400/23
See application file for complete search history.

(56) References Cited

U.S. PATENT DOCUMENTS

| | | | | |
|---|---|---|---|---|
| 2013/0274948 | A1* | 10/2013 | Matsuo ..... | F24F 11/84 700/300 |
| 2017/0254568 | A1 | 9/2017 | Miyoshi et al. | |
| 2019/0017730 | A1 | 1/2019 | Matsukura et al. | |

FOREIGN PATENT DOCUMENTS

| | | | |
|---|---|---|---|
| JP | 8-189726 | A | 7/1996 |
| JP | 2004-239493 | A | 8/2004 |
| JP | 2009-250566 | A | 10/2009 |
| JP | 2010-32105 | A | 2/2010 |
| JP | 2010-515006 | A | 5/2010 |
| JP | 2016-56966 | A | 4/2016 |
| JP | 2017-146068 | A | 8/2017 |
| JP | 2019-158203 | A | 9/2019 |

* cited by examiner

REFRIGERATION MACHINE

TECHNICAL FIELD

The present disclosure relates to a chiller including a liquid film type evaporator.

BACKGROUND ART

A chiller includes a compressor, a condenser, an expansion valve, and an evaporator. In a refrigerating cycle of the chiller, the compressor compresses a refrigerant, the condenser exchanges heat with the high-temperature and high-pressure refrigerant to condense the refrigerant, and the expansion valve expands the condensed liquid refrigerant, and the evaporator exchanges heat between the expanded refrigerant and a medium to be cooled, to evaporate the refrigerant. The evaporator is used, for example, to cool an inside of a freezer.

As the evaporator used in the chiller, there is a full liquid type evaporator. The full liquid type evaporator immerses the heat transfer tube in a refrigerant liquid inside a casing, and evaporates the refrigerant liquid by pool boiling. Therefore, it is necessary to store a large amount of the refrigerant liquid inside the casing, and thus the cost is increased. On the other hand, as the evaporator, there is a liquid film type evaporator. The liquid film type evaporator allows the refrigerant liquid to flow down to the heat transfer tube inside the casing to evaporate the refrigerant liquid. Therefore, it is not necessary to store a large amount of the refrigerant liquid inside the casing, and thus a holding amount of the refrigerant can be reduced.

As such an evaporator in the related art, for example, there are evaporators disclosed in PTL 1 and PTL 2.

CITATION LIST

Patent Literature

[PTL 1] Japanese Unexamined Patent Application Publication No. 2019-158203

[PTL 2] Japanese Unexamined Patent Application Publication No. 2004-239493

SUMMARY OF INVENTION

Technical Problem

However, in the liquid film type evaporator described above, it is necessary to allow the refrigerant liquid in an amount equal to or larger than an evaporation amount to flow down to the heat transfer tube, and thus an unevaporated refrigerant liquid is stored in a lower portion of the casing. Therefore, it is necessary to circulate the unevaporated refrigerant liquid to the upper portion of the casing by means of a pump or the like, and thus there are problems that a size of an apparatus is increased and a cost is increased.

The present disclosure has been made to solve the problems described above, and an object of the present disclosure is to provide a chiller that suppresses an increase in a size and an increase in a cost of an apparatus.

Solution to Problem

In order to the object described above, the present disclosure relates to a chiller including a compressor that compresses a refrigerant, a condenser that condenses the refrigerant compressed by the compressor, an expander that expands the refrigerant condensed by the condenser, a liquid film type evaporator that evaporates the refrigerant expanded by the expander, and an eductor that uses a pressure difference between an inlet and an outlet to suck the refrigerant stored in the evaporator.

Advantageous Effects of Invention

With the chiller of the present disclosure, it is possible to suppress the increase in the size and the increase in the cost of the apparatus.

DESCRIPTION OF EMBODIMENTS

Hereinafter, preferred embodiments of the present disclosure will be described in detail with reference to the drawings. The present disclosure is not limited to the embodiments, and includes a configuration in which embodiments are combined in a case in which there are a plurality of embodiments. In addition, components in the embodiment include components that can be easily assumed by those skilled in the art, components that are substantially the same, that is, components having a so-called equivalent range.

First Embodiment

<Configuration of Chiller>

Figure 1:
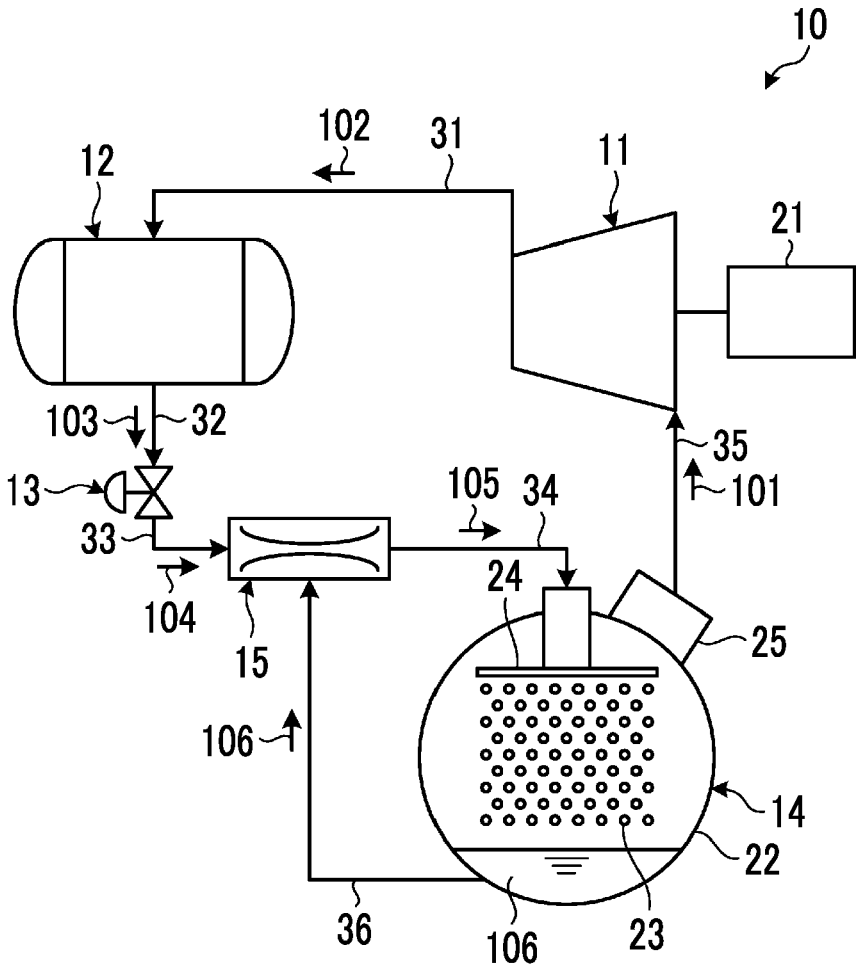
FIG. 1 is a schematic configuration diagram showing a chiller according to a first embodiment.

FIG. 1 is a schematic configuration diagram showing a chiller according to a first embodiment.

In the first embodiment, as shown in FIG. 1, a chiller 10 includes a compressor 11, a condenser 12, an expansion valve (expander) 13, an evaporator 14, and an eductor 15. A subcooler (heat exchanger) may be provided between the condenser 12 and the expansion valve 13.

The compressor 11 is a single-stage compressor, and is driven by an electric motor 21, for example. The compressor 11 is connected to the condenser 12 via a refrigerant passage 31. The compressor 11 compresses a refrigerant gas (refrigerant) 101 to generate a high-temperature and high-pressure refrigerant gas (refrigerant) 102. The condenser 12 is connected to the expansion valve 13 via a refrigerant passage 32. The condenser 12 generates a refrigerant liquid (refrigerant) 103 by cooling the high-temperature and high-pressure refrigerant gas 102 compressed by the compressor 11 to condense the refrigerant gas 102. The expansion valve 13 is connected to the eductor 15 via a refrigerant passage 33. The expansion valve 13 generates a low-pressure refrigerant liquid (refrigerant) 104 by reducing the pressure to expand the refrigerant liquid 103 condensed by the condenser 12.

The eductor 15 is connected to the evaporator 14 via a refrigerant passage 34. The eductor 15 injects, as a refrigerant liquid (refrigerant) 105, the low-pressure refrigerant liquid 104 expanded by the expansion valve 13 to the refrigerant passage 34 side. In this case, the eductor 15 uses a pressure difference between the refrigerant liquid 104 and the refrigerant liquid (refrigerant) 105 to suck a refrigerant liquid (refrigerant) 106 stored in the evaporator 14. The evaporator 14 is connected to the compressor 11 via a refrigerant passage 35. The evaporator 14 is a liquid film type. The refrigerant liquids 104 and 105 are refrigerant liquids or two-phase refrigerants.

The evaporator 14 includes a casing 22, a large number of heat transfer tubes 23, a refrigerant supply unit 24, and a refrigerant discharge unit 25. The large number of heat transfer tubes 23 are disposed inside the casing 22. The large number of heat transfer tubes 23 are disposed at predetermined intervals from each other along a horizontal direction. A medium to be cooled flows inside the large number of heat transfer tubes 23. The refrigerant supply unit 24 is provided in an upper portion of the casing 22, and is connected to a downstream end portion in the refrigerant passage 34. The refrigerant discharge unit 25 is disposed adjacent to the refrigerant supply unit 24 in the upper portion of the casing 22. An upstream end portion of the refrigerant passage 35 is connected to the refrigerant discharge unit 25. In addition, a lower portion of the casing 22 and the eductor 15 are connected to each other via a refrigerant passage 36.

Although not shown, the eductor 15 includes, for example, a body, a diffuser, and a nozzle. In the eductor 15, the diffuser communicates with the body, and the nozzle is provided in the body. The refrigerant passage 36 is connected to the body, the refrigerant passage 34 is connected to the diffuser, and the refrigerant passage 33 is connected to the nozzle. Therefore, in a case in which the refrigerant liquid 104 from the refrigerant passage 33 is injected from the nozzle at high speed, the refrigerant liquid 104 is discharged, as the refrigerant liquid 105, from the diffuser to the refrigerant passage 34. In this case, a pressure inside the body is reduced, the refrigerant liquid 106 is sucked through the refrigerant passage 36, and is discharged, as the refrigerant liquid 105, from the diffuser to the refrigerant passage 34. The eductor 15 is not limited to this configuration.

The evaporator 14 evaporates the refrigerant liquid 105 including the refrigerant liquid 106 to generate the refrigerant gas (refrigerant) 101. The refrigerant supply unit 24 allows the refrigerant liquid 105 supplied from the refrigerant passage 34 to flow down inside the casing 22. The flow-down refrigerant liquid 105 comes into contact with the large number of heat transfer tubes 23 through which the medium to be cooled flows, a part of the refrigerant liquid 105 is evaporated to serve as the refrigerant gas 101, and the rest serves as the refrigerant liquid 106 stored in the lower portion of the casing 22.

<Refrigerating Cycle of Chiller>

A refrigerating cycle using the chiller 10 is a single-stage refrigerating cycle. The compressor 11 compresses the refrigerant gas 101 from the evaporator 14 to obtain the high-temperature and high-pressure refrigerant gas 102 (compression stroke). The condenser 12 condenses the high-temperature and high-pressure refrigerant gas 102 to obtain the refrigerant liquid 103 (condensation stroke). The expansion valve 13 expands the condensed refrigerant liquid 103 to obtain the low-pressure refrigerant liquid 104 (expansion stroke). The eductor 15 injects the low-pressure refrigerant liquid 104 toward the evaporator 14. Therefore, a suction force generated by the injection of the refrigerant liquid 104 acts on the refrigerant passage 36, and the refrigerant liquid 106 stored in a lower portion of the evaporator 14 is sucked through the refrigerant passage 36. That is, the eductor 15 supplies the refrigerant liquid 106 stored in the evaporator 14 to the evaporator 14 together with the refrigerant liquid 104 expanded by the expansion valve 13. The evaporator 14 allows the refrigerant liquid 105 to flow down from the refrigerant supply unit 24 and brings a liquid phase portion of the refrigerant liquid 105 into contact with the large number of heat transfer tubes 23 to generate the refrigerant gas 101 (evaporation stroke), and the refrigerant gas 101 is supplied to the compressor 11. In addition, in the evaporator 14, the unevaporated refrigerant liquid 106 is stored in the lower portion of the casing 22, but is returned to the refrigerant supply unit 24 by the eductor 15 as described above.

Here, it is necessary to adjust the temperature and the pressure of the refrigerant liquid 105 supplied to the evaporator 14 to a predetermined temperature and a predetermined pressure. In the related art, the temperature and the pressure of the refrigerant liquid 105 supplied to the evaporator 14 have been adjusted by expanding the refrigerant liquid 103 using the expansion valve 13 to reduce the pressure. On the other hand, in the first embodiment, the temperature and the pressure of the refrigerant liquid 105 supplied to the evaporator 14 are adjusted by expanding the refrigerant liquid 103 using the expansion valve 13 and the eductor 15 to reduce the pressure. That is, a part of a pressure loss in the expansion valve 13, which has been discarded in the related art, is used as an operating power of the eductor 15. Therefore, it is possible to return the refrigerant liquid 106 stored in the lower portion of the evaporator 14 to the refrigerant supply unit 24 without using a separate pump and the like. An opening degree of the expansion valve 13 may be adjustable, and a pressure reduction distribution between the expansion valve 13 and the eductor 15 may be adjustable.

Second Embodiment

Figure 2:
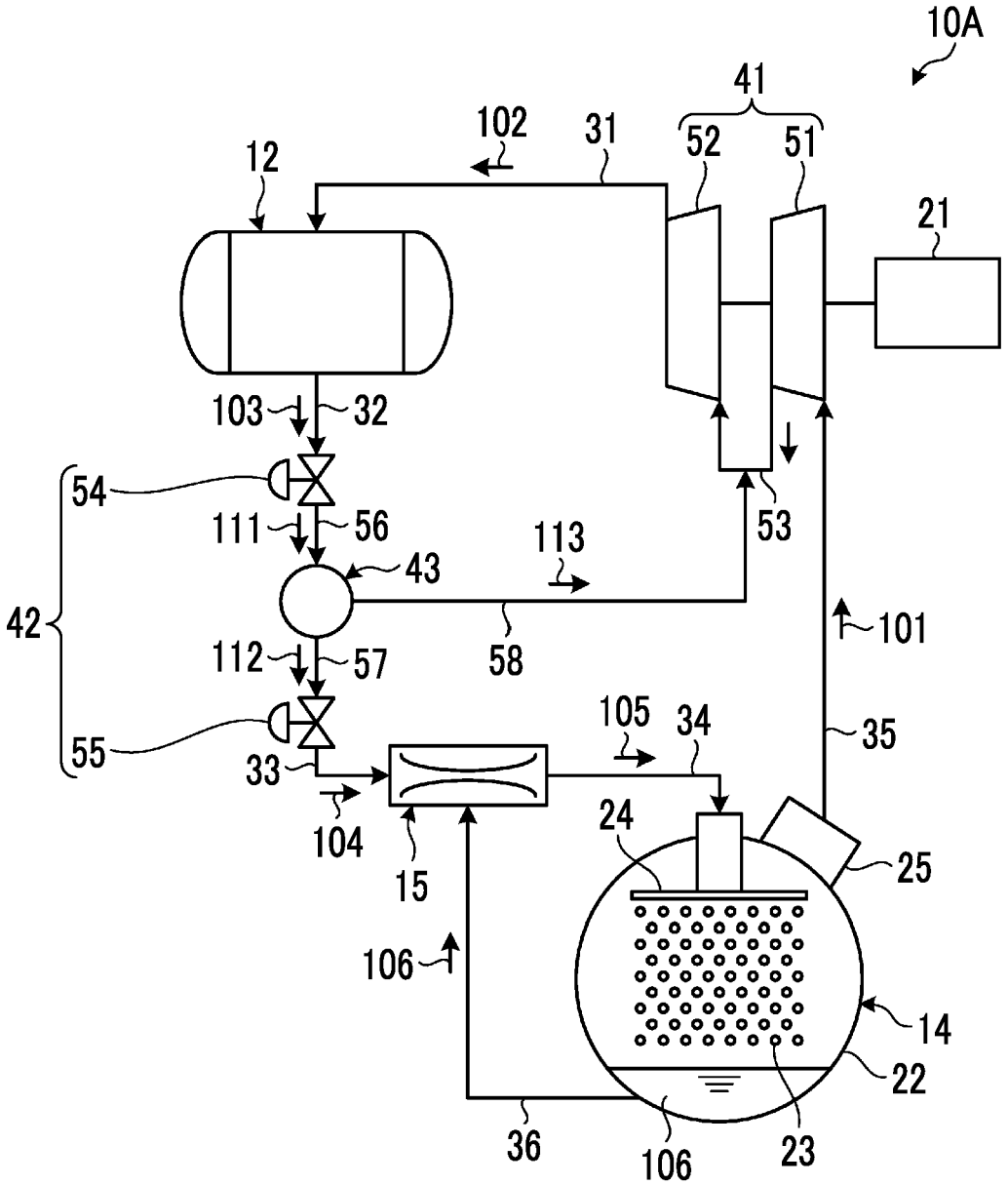
FIG. 2 is a schematic configuration diagram showing a chiller according to a second embodiment.

FIG. 2 is a schematic configuration diagram showing a chiller according to a second embodiment. The same reference numerals are given to the members having the same functions as the members in the first embodiment described above, and the detailed description thereof will be omitted.

In the second embodiment, as shown in FIG. 2, a chiller 10A includes a compressor 41, a condenser 12, an expansion valve 42, an evaporator 14, an eductor 15, and an economizer (first gas-liquid separator) 43.

The compressor 41 is a multi-stage compressor (in the present embodiment, a two-stage compressor), and includes a first compressor 51 and a second compressor 52. The compressor 41 is driven by the electric motor 21, for example. The first compressor 51 and the second compressor 52 are connected to each other via a refrigerant passage 53. The second compressor 52 is connected to the condenser 12 via the refrigerant passage 31. The compressor 41 compresses the refrigerant gas 101 to generate the high-temperature and high-pressure refrigerant gas 102.

The condenser 12 generates the refrigerant liquid 103 by cooling the high-temperature and high-pressure refrigerant gas 102 compressed by the compressor 41 to condense the refrigerant gas 102. The expansion valve 42 includes a first expansion valve 54 and a second expansion valve 55. The first expansion valve 54 and the second expansion valve 55 are disposed in series with the discharge passage of the refrigerant liquid 103 condensed by the condenser 12. The economizer 43 is disposed between the first expansion valve 54 and the second expansion valve 55. That is, the condenser 12 is connected to the first expansion valve 54 via the refrigerant passage 32. The first expansion valve 54 is connected to the economizer 43 via a refrigerant passage 56. The economizer 43 is connected to the second expansion valve 55 via a refrigerant passage 57 and is connected to the refrigerant passage 53 via a refrigerant passage 58. The second expansion valve 55 is connected to the eductor 15 via the refrigerant passage 33.

The first expansion valve 54 generates a low-pressure refrigerant liquid (refrigerant) 111 by expanding the refrigerant liquid 103 condensed by the condenser 12 to reduce the pressure. The economizer 43 performs gas-liquid separation on the low-pressure refrigerant liquid 111 into a refrigerant liquid (refrigerant) 112 and a refrigerant gas (refrigerant) 113. The second expansion valve 55 generates the low-pressure refrigerant liquid 104 by expanding the refrigerant liquid 112 to reduce the pressure. On the other hand, the refrigerant gas 113 is supplied to the second compressor 52.

The eductor 15 is connected to the refrigerant supply unit 24 of the evaporator 14 via the refrigerant passage 34, and is connected to the lower portion of the casing 22 via the refrigerant passage 36. The eductor 15 injects, as the refrigerant liquid 105, the low-pressure refrigerant liquid 104 expanded by the second expansion valve 55 to the refrigerant passage 34 side. In this case, the eductor 15 generates a flow speed difference and a pressure difference in the refrigerant liquid 104, and sucks the refrigerant liquid 106 stored in the evaporator 14.

The evaporator 14 is connected to the compressor 11 via the refrigerant passage 35. The evaporator 14 is a liquid film type. The evaporator 14 evaporates the refrigerant liquid 105 including the refrigerant liquid 106 to generate the refrigerant gas 101. A part of the refrigerant liquid 105 is evaporated and supplied as the refrigerant gas 101 to the compressor 41, and the rest serves as the refrigerant liquid 106 stored in the lower portion of the casing 22.

A refrigerating cycle using the chiller 10A is a two-stage compression two-stage expansion refrigerating cycle. The compressor 41 compresses the refrigerant gas 101 from the evaporator 14 to obtain the high-temperature and high-pressure refrigerant gas 102. The condenser 12 condenses the high-temperature and high-pressure refrigerant gas 102 to obtain the refrigerant liquid 103. The first expansion valve 54 expands the condensed refrigerant liquid 103 to obtain the low-pressure refrigerant liquid 111. The economizer 43 performs gas-liquid separation on the low-pressure refrigerant liquid 111 into the refrigerant liquid 112 and the refrigerant gas (refrigerant) 113, and supplies the refrigerant gas 113 to the second compressor 52. The second expansion valve 55 generates the low-pressure refrigerant liquid 104 by expanding the refrigerant liquid 112 to reduce the pressure. The eductor 15 injects the low-pressure refrigerant liquid 104 toward the evaporator 14, and sucks the refrigerant liquid 106 in the lower portion of the evaporator 14. That is, the eductor 15 supplies the refrigerant liquid 106 stored in the evaporator 14 to the evaporator 14 together with the refrigerant liquid 104 expanded by the expansion valve 13. The evaporator 14 evaporates a part of the refrigerant liquid 105 to generate the refrigerant gas 101, and supplies the refrigerant gas 101 to the compressor 11. In addition, in the evaporator 14, the unevaporated refrigerant liquid 106 is stored in the lower portion of the casing 22, but is returned to the refrigerant supply unit 24 by the eductor 15.

Third Embodiment

Figure 3:
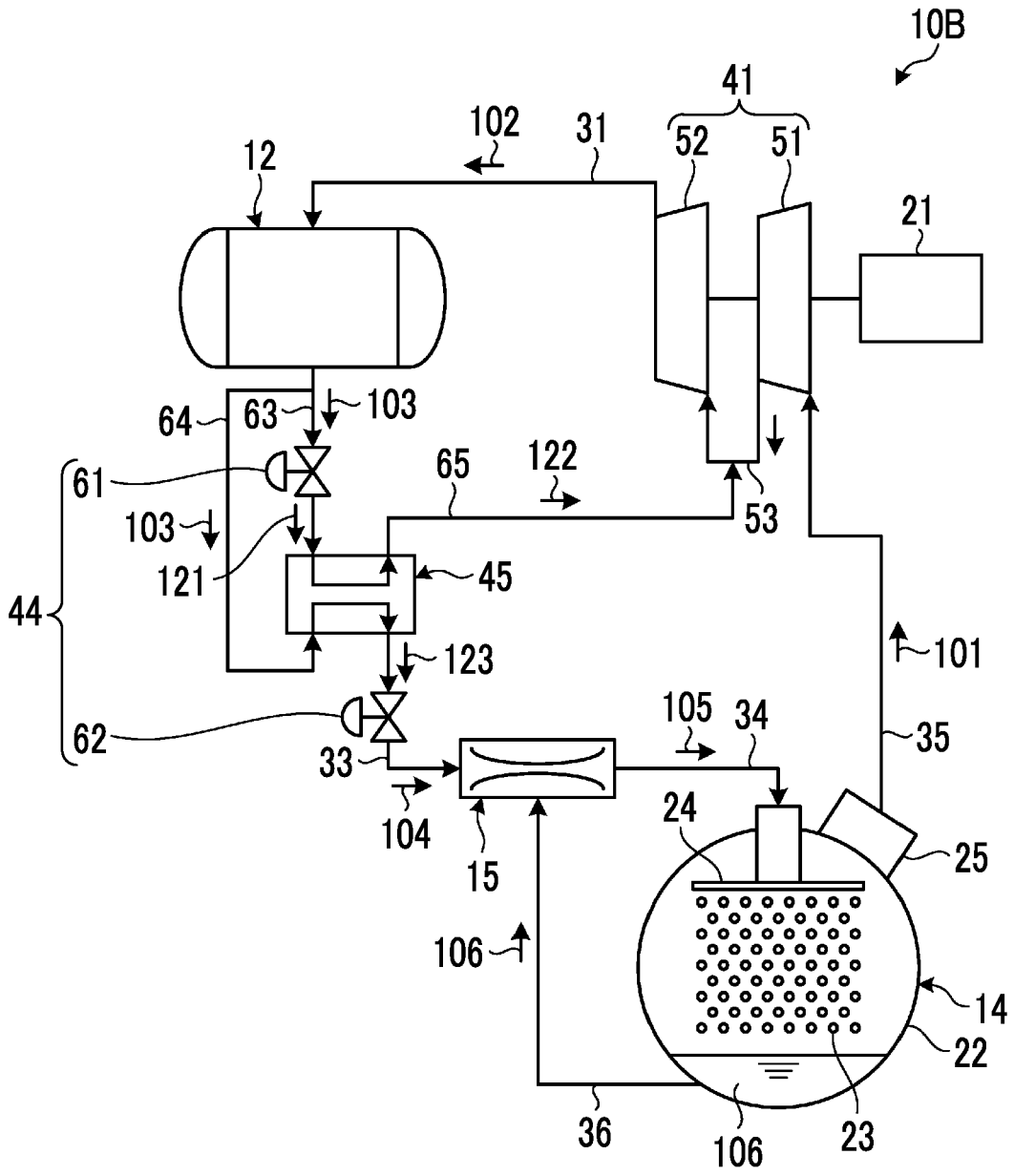
FIG. 3 is a schematic configuration diagram showing a chiller according to a third embodiment.

FIG. 3 is a schematic configuration diagram showing a chiller according to a third embodiment. The same reference numerals are given to the members having the same functions as the members in the second embodiment described above, and the detailed description thereof will be omitted.

In the third embodiment, as shown in FIG. 3, a chiller 10B includes the compressor 41, the condenser 12, an expansion valve 44, the evaporator 14, the eductor 15, and an economizer (first heat exchanger) 45.

The compressor 41 includes the first compressor 51 and the second compressor 52. The first compressor 51 and the second compressor 52 are connected to each other via the refrigerant passage 53. The second compressor 52 is connected to the condenser 12 via the refrigerant passage 31. The compressor 41 compresses the refrigerant gas 101 to generate the high-temperature and high-pressure refrigerant gas 102.

The condenser 12 generates the refrigerant liquid 103 by cooling the high-temperature and high-pressure refrigerant gas 102 compressed by the compressor 41 to condense the refrigerant gas 102. The expansion valve 44 includes a first expansion valve 61 and a second expansion valve 62. The first expansion valve 61 and the second expansion valve 62 are disposed in parallel to the discharge passage of the refrigerant liquid 103 condensed by the condenser 12. The economizer 45 is disposed between the first expansion valve 61 and the second expansion valve 62. That is, the condenser 12 is connected to the refrigerant passages 63 and 64 branched into two passages. One refrigerant passage 63 is connected to the first expansion valve 61, and the first expansion valve 61 is connected to the refrigerant passage 53 via a refrigerant passage 65. The other refrigerant passage 64 is connected to the second expansion valve 62, and the second expansion valve 62 is connected to the eductor 15 via the refrigerant passage 33. The economizer 45 is provided between the refrigerant passages 64 and 65.

The first expansion valve 61 generates a low-pressure refrigerant liquid (refrigerant) 121 by expanding the refrigerant liquid 103 condensed by the condenser 12 to reduce the pressure. The economizer 45 generates a refrigerant gas (refrigerant) 122 by exchanging heat between the refrigerant liquid (second refrigerant) 103 flowing through the refrigerant passage 64 and the refrigerant liquid (first refrigerant) 121 flowing through the refrigerant passage 65. The refrigerant gas 122 is supplied to the second compressor 52. The second expansion valve 62 generates the low-pressure refrigerant liquid 104 by expanding a refrigerant liquid 123 heat-exchanged by the economizer 45 to reduce the pressure.

The eductor 15 is connected to the refrigerant supply unit 24 of the evaporator 14 via the refrigerant passage 34, and is connected to the lower portion of the casing 22 via the refrigerant passage 36. The eductor 15 injects, as the refrigerant liquid 105, the low-pressure refrigerant liquid 104 expanded by the second expansion valve 62 to the refrigerant passage 34 side. In this case, the eductor 15 generates the flow speed difference and the pressure difference in the refrigerant liquid 104, and sucks the refrigerant liquid 106 stored in the evaporator 14.

The evaporator 14 is connected to the compressor 11 via the refrigerant passage 35. The evaporator 14 is a liquid film type. The evaporator 14 evaporates the refrigerant liquid 105 including the refrigerant liquid 106 to generate the refrigerant gas 101. A part of the refrigerant liquid 105 is evaporated and supplied as the refrigerant gas 101 to the compressor 41, and the rest serves as the refrigerant liquid 106 stored in the lower portion of the casing 22.

A refrigerating cycle using the chiller 10B is a two-stage compression one-stage expansion refrigerating cycle. The compressor 41 compresses the refrigerant gas 101 from the evaporator 14 to obtain the high-temperature and high-pressure refrigerant gas 102. The condenser 12 condenses the high-temperature and high-pressure refrigerant gas 102 to obtain the refrigerant liquid 103. The first expansion valve 61 expands the condensed refrigerant liquid 103 to obtain the low-pressure refrigerant liquid 121. The economizer 45 generates the refrigerant gas 122 by exchanging heat between the refrigerant liquid 103 and the refrigerant liquid 121, and supplies the refrigerant gas 122 to the second compressor 52. The second expansion valve 62 generates the low-pressure refrigerant liquid 104 by expanding the refrigerant liquid 123 to reduce the pressure. The eductor 15 injects the low-pressure refrigerant liquid 104 toward the evaporator 14, and sucks the refrigerant liquid 106 in the lower portion of the evaporator 14. That is, the eductor 15 supplies the refrigerant liquid 106 stored in the evaporator 14 to the evaporator 14 together with the refrigerant liquid 104 expanded by the expansion valve 13. The evaporator 14 evaporates a part of the refrigerant liquid 105 to generate the refrigerant gas 101, and supplies the refrigerant gas 101 to the compressor 11. In addition, in the evaporator 14, the unevaporated refrigerant liquid 106 is stored in the lower portion of the casing 22, but is returned to the refrigerant supply unit 24 by the eductor 15.

Fourth Embodiment

Figure 4:
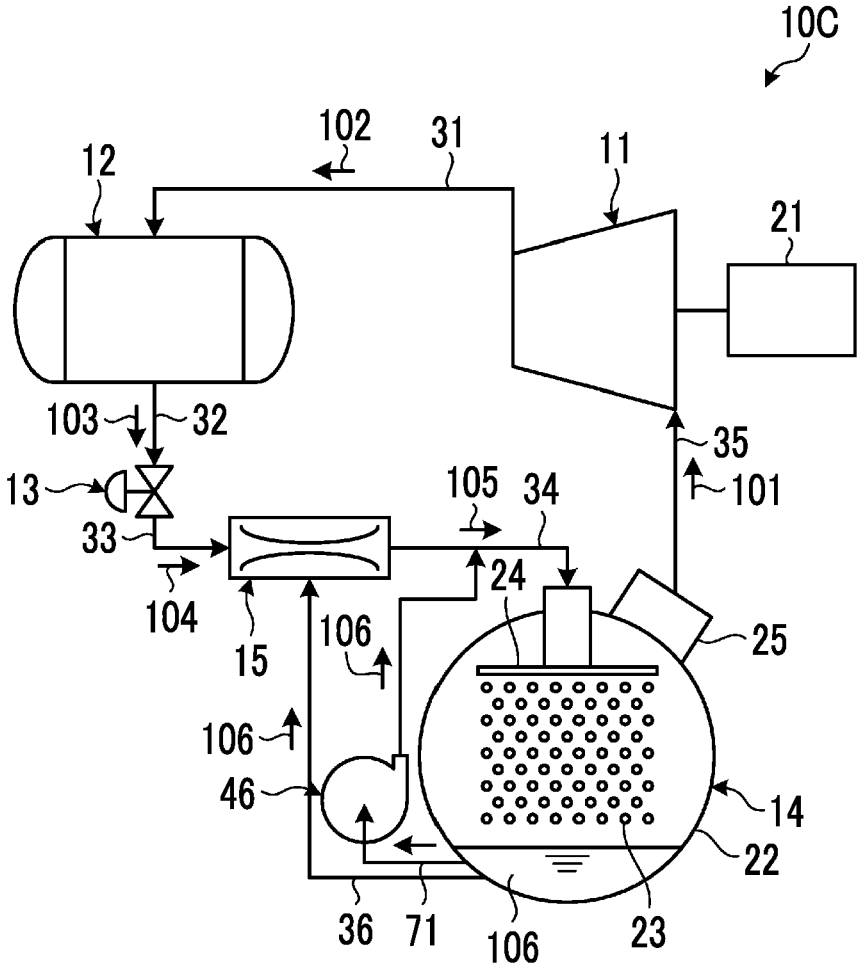
FIG. 4 is a schematic configuration diagram showing a chiller according to a fourth embodiment.

FIG. 4 is a schematic configuration diagram showing a chiller according to a fourth embodiment. The same reference numerals are given to the members having the same functions as the members in the first embodiment described above, and the detailed description thereof will be omitted.

In the fourth embodiment, as shown in FIG. 4, a chiller 10C includes the compressor 11, the condenser 12, the expansion valve 13, the evaporator 14, the eductor 15, and an auxiliary pump 46.

The compressor 11 is connected to the condenser 12 via the refrigerant passage 31. The compressor 11 compresses the refrigerant gas 101 to generate the high-temperature and high-pressure refrigerant gas 102. The condenser 12 is connected to the expansion valve 13 via the refrigerant passage 32. The condenser 12 generates the refrigerant liquid 103 by cooling the high-temperature and high-pressure refrigerant gas 102 compressed by the compressor 11 to condense the refrigerant gas 102. The expansion valve 13 is connected to the eductor 15 via a refrigerant passage 33. The expansion valve 13 generates the low-pressure refrigerant liquid 104 by expanding the refrigerant liquid 103 condensed by the condenser 12 to reduce the pressure.

The eductor 15 is connected to the refrigerant supply unit 24 of the evaporator 14 via the refrigerant passage 34, and is connected to the lower portion of the casing 22 via the refrigerant passage 36. The eductor 15 injects, as the refrigerant liquid 105, the low-pressure refrigerant liquid 104 expanded by the second expansion valve 62 to the refrigerant passage 34 side. In this case, the eductor 15 generates the flow speed difference and the pressure difference in the refrigerant liquid 104, and sucks the refrigerant liquid 106 stored in the evaporator 14.

Although not shown, the auxiliary pump 46 is driven by an electric motor. The auxiliary pump 46 supplies the refrigerant liquid 106 stored in the evaporator 14 to the refrigerant passage 34 as a discharge passage of the eductor 15. The lower portion of the casing 22 in the evaporator 14 and the refrigerant passage 34 are connected to each other via a refrigerant passage 71. The auxiliary pump 46 is provided in the refrigerant passage 71.

The evaporator 14 is connected to the compressor 11 via the refrigerant passage 35. The evaporator 14 is a liquid film type. The evaporator 14 evaporates the refrigerant liquid 105 including the refrigerant liquid 106 to generate the refrigerant gas 101. A part of the refrigerant liquid 105 is evaporated and supplied as the refrigerant gas 101 to the compressor 41, and the rest serves as the refrigerant liquid 106 stored in the lower portion of the casing 22.

A refrigerating cycle using the chiller 10C is a single-stage refrigerating cycle. The compressor 41 compresses the refrigerant gas 101 from the evaporator 14 to obtain the high-temperature and high-pressure refrigerant gas 102. The condenser 12 condenses the high-temperature and high-pressure refrigerant gas 102 to obtain the refrigerant liquid 103. The expansion valve 13 expands the condensed refrigerant liquid 103 to obtain the low-pressure refrigerant liquid 104. The eductor 15 injects the low-pressure refrigerant liquid 104 toward the evaporator 14, and sucks the refrigerant liquid 106 in the lower portion of the evaporator 14. In addition, the auxiliary pump 46 supplies the refrigerant liquid 106 stored in the evaporator 14 to the refrigerant passage 34. That is, by the eductor 15 and the auxiliary pump 46, the refrigerant liquid 106 stored in the evaporator 14 is supplied to the evaporator 14 together with the refrigerant liquid 104 expanded by the expansion valve 13. The evaporator 14 evaporates a part of the refrigerant liquid 105 to generate the refrigerant gas 101, and supplies the refrigerant gas 101 to the compressor 11. In addition, in the evaporator 14, the unevaporated refrigerant liquid 106 is stored in the lower portion of the casing 22, but is returned to the refrigerant supply unit 24 by the eductor 15 and the auxiliary pump 46.

The refrigerant liquid 106 stored in the lower portion of the evaporator 14 is returned to the refrigerant supply unit 24 of the evaporator 14 by the eductor 15 and the auxiliary pump 46. In this case, in a case in which a pressure difference between an inlet portion of the eductor 15 (outlet portion of the expansion valve 13) and an inlet portion of the evaporator 14 is equal to or larger than a predetermined value, it is possible to return the refrigerant liquid 106 in the lower portion of the evaporator 14 to the refrigerant supply unit 24 of the evaporator 14 only by the eductor 15. On the other hand, in a case in which the pressure difference between the inlet portion of the eductor 15 (outlet portion of the expansion valve 13) and the inlet portion of the evaporator 14 is lower than the predetermined value, it is difficult to return the refrigerant liquid 106 in the lower portion of the evaporator 14 to the refrigerant supply unit 24 of the evaporator 14 by a necessary amount only by the eductor 15. In this case, the auxiliary pump 46 is used in an auxiliary manner to return the refrigerant liquid 106 in the lower portion of the evaporator 14 to the refrigerant supply unit 24 of the evaporator 14 by the eductor 15 and the auxiliary pump 46.

In a case in which it is difficult to return the refrigerant liquid 106 in the lower portion of the evaporator 14 to the refrigerant supply unit 24 of the evaporator 14 by the necessary amount only by the operation of the eductor 15 even when the chiller 10C is in a rated operation, the auxiliary pump 46 is operated. In addition, in a case in which the pressure difference between the inlet portion of the eductor 15 and the inlet portion of the evaporator 14 is small and it is difficult to return the refrigerant liquid 106 in the lower portion of the evaporator 14 to the refrigerant supply unit 24 of the evaporator 14 by the necessary amount only by the operation of the eductor 15 when the chiller 10C is in a partial load operation, the auxiliary pump 46 is operated.

In this case, although not shown, a sensor that detects a storage amount of the refrigerant liquid 106 stored in the lower portion of the casing 22 in the evaporator 14 may be provided, and a control device may control the operation of the auxiliary pump 46 according to the storage amount of the refrigerant liquid 106 detected by a sensor. That is, the control device operates the auxiliary pump 46 in a case in which the storage amount of the refrigerant liquid 106 exceeds a preset upper limit storage amount, and stops the operation of the auxiliary pump 46 in a case in which the storage amount of the refrigerant liquid 106 falls below a preset lower limit storage amount. The control by the control device may be manually carried out by an operator.

Fifth Embodiment

Figure 5:
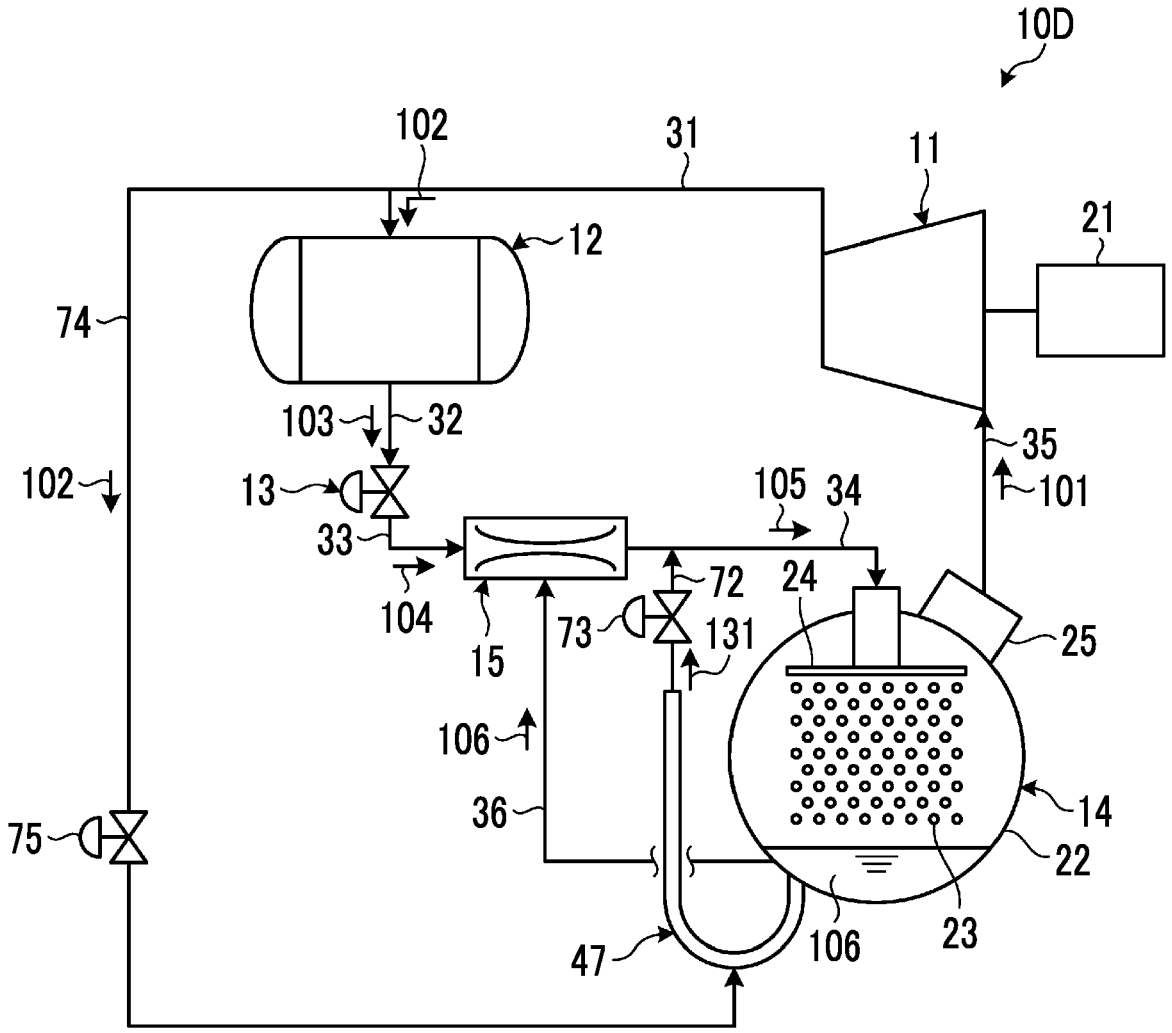
FIG. 5 is a schematic configuration diagram showing a chiller according to a fifth embodiment.

FIG. 5 is a schematic configuration diagram showing a chiller according to a fifth embodiment. The same reference numerals are given to the members having the same functions as the members in the fourth embodiment described above, and the detailed description thereof will be omitted.

In the fifth embodiment, as shown in FIG. 5, a chiller 10D includes the compressor 11, the condenser 12, the expansion valve 13, the evaporator 14, the eductor 15, and a bubble pump (auxiliary pump) 47.

The compressor 11 is connected to the condenser 12 via the refrigerant passage 31. The compressor 11 compresses the refrigerant gas 101 to generate the high-temperature and high-pressure refrigerant gas 102. The condenser 12 is connected to the expansion valve 13 via the refrigerant passage 32. The condenser 12 generates the refrigerant liquid 103 by cooling the high-temperature and high-pressure refrigerant gas 102 compressed by the compressor 11 to condense the refrigerant gas 102. The expansion valve 13 is connected to the eductor 15 via a refrigerant passage 33. The expansion valve 13 generates the low-pressure refrigerant liquid 104 by expanding the refrigerant liquid 103 condensed by the condenser 12 to reduce the pressure.

The eductor 15 is connected to the refrigerant supply unit 24 of the evaporator 14 via the refrigerant passage 34, and is connected to the lower portion of the casing 22 via the refrigerant passage 36. The eductor 15 injects, as the refrigerant liquid 105, the low-pressure refrigerant liquid 104 expanded by the second expansion valve 62 to the refrigerant passage 34 side. In this case, the eductor 15 generates the flow speed difference and the pressure difference in the refrigerant liquid 104, and sucks the refrigerant liquid 106 stored in the evaporator 14.

The bubble pump 47 supplies the refrigerant liquid 106 stored in the evaporator 14 to the refrigerant passage 34 as the discharge passage of the eductor 15. The bubble pump 47 is provided in the lower portion of the casing 22 of the evaporator 14. The bubble pump 47 is connected to the refrigerant passage 34 via a refrigerant passage 72, and an opening-closing valve 73 is provided in the refrigerant passage 72. The bubble pump 47 has a U-shape, and has one end portion connected to the lower portion of the casing 22 of the evaporator 14 and the other end portion connected to the refrigerant passage 72. A refrigerant passage 74 is provided as a branch from the refrigerant passage 31 that connects the compressor 11 and the condenser 12 to each other. The refrigerant passage 74 is provided with an opening-closing valve 75, and is connected to a lower portion of the bubble pump 47. In the bubble pump 47, the refrigerant gas (refrigerant) 102 is supplied from the refrigerant passage 74 to the lower portion of the U-shape. The bubble pump 47 uses a specific gravity difference between the refrigerant gas 102 supplied to the lower portion and the refrigerant liquid 106 stored in the lower portion of the evaporator 14 to supply the refrigerant liquid 106 of the evaporator 14 to the refrigerant passage 34 via the refrigerant passage 72 by the refrigerant gas 102.

The evaporator 14 is connected to the compressor 11 via the refrigerant passage 35. The evaporator 14 is a liquid film type. The evaporator 14 evaporates the refrigerant liquid 105 including the refrigerant liquid 106 to generate the refrigerant gas 101. A part of the refrigerant liquid 105 is evaporated and supplied as the refrigerant gas 101 to the compressor 41, and the rest serves as the refrigerant liquid 106 stored in the lower portion of the casing 22.

A refrigerating cycle using the chiller 10D is a single-stage refrigerating cycle. The compressor 11 compresses the refrigerant gas 101 from the evaporator 14 to obtain the high-temperature and high-pressure refrigerant gas 102. The condenser 12 condenses the high-temperature and high-pressure refrigerant gas 102 to obtain the refrigerant liquid 103. The expansion valve 13 expands the condensed refrigerant liquid 103 to obtain the low-pressure refrigerant liquid 104. The eductor 15 injects the low-pressure refrigerant liquid 104 toward the evaporator 14, and sucks the refrigerant liquid 106 in the lower portion of the evaporator 14. In addition, in a case in which the opening-closing valves 73 and 75 are opened, the bubble pump 47 is operated, and the refrigerant liquid 106 of the evaporator 14 is supplied from the refrigerant passage 72 to the refrigerant passage 34 by the refrigerant gas 102. That is, by the eductor 15 and the bubble pump 47, the refrigerant liquid 106 stored in the evaporator 14 is supplied to the evaporator 14 together with the refrigerant liquid 104 expanded by the expansion valve 13. The evaporator 14 evaporates a part of the refrigerant liquid 105 to generate the refrigerant gas 101, and supplies the refrigerant gas 101 to the compressor 11. In addition, in the evaporator 14, the unevaporated refrigerant liquid 106 is stored in the lower portion of the casing 22, but is returned to the refrigerant supply unit 24 by the eductor 15 and the auxiliary pump 46.

An operating condition of the bubble pump 47 is the same as an operating condition of the auxiliary pump 46 described in the fourth embodiment.

Sixth Embodiment

Figure 6:
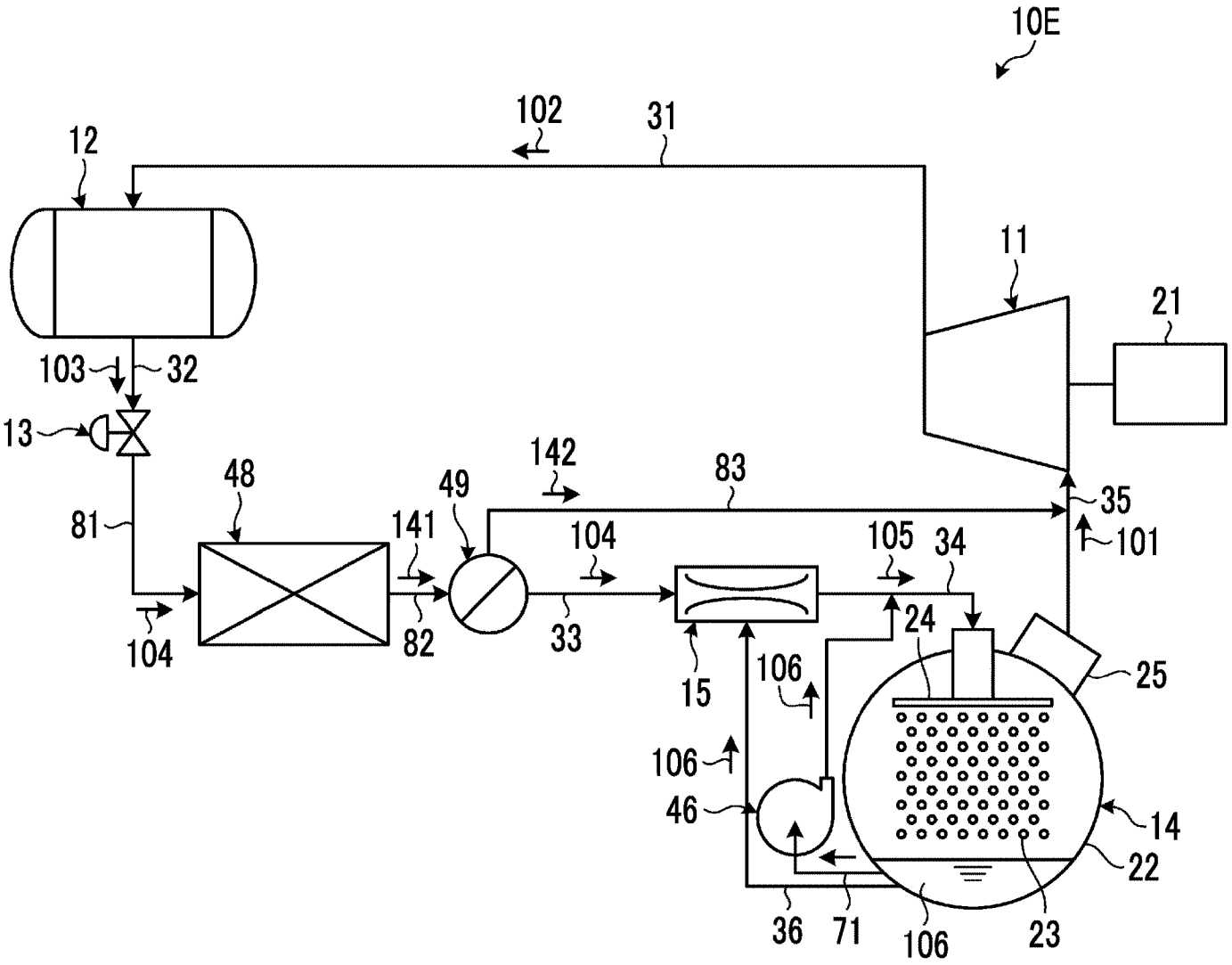
FIG. 6 is a schematic configuration diagram showing a chiller according to a sixth embodiment.

FIG. 6 is a schematic configuration diagram showing a chiller according to a sixth embodiment. The same reference numerals are given to the members having the same functions as the members in the first embodiment described above, and the detailed description thereof will be omitted.

In the sixth embodiment, as shown in FIG. 6, a chiller 10E includes the compressor 11, the condenser 12, the expansion valve 13, the evaporator 14, the eductor 15, a plate-type heat exchanger (second heat exchanger) 48, and a gas-liquid separator (second gas-liquid separator) 49.

The compressor 11 is connected to the condenser 12 via the refrigerant passage 31. The compressor 11 compresses the refrigerant gas 101 to generate the high-temperature and high-pressure refrigerant gas 102. The condenser 12 is connected to the expansion valve 13 via the refrigerant passage 32. The condenser 12 generates the refrigerant liquid 103 by cooling the high-temperature and high-pressure refrigerant gas 102 compressed by the compressor 11 to condense the refrigerant gas 102. The expansion valve 13 is connected to the plate-type heat exchanger via a refrigerant passage 81. The expansion valve 13 generates the low-pressure refrigerant liquid 104 by expanding the refrigerant liquid 103 condensed by the condenser 12 to reduce the pressure.

The plate-type heat exchanger 48 is connected to the gas-liquid separator 49 via a refrigerant passage 82. The gas-liquid separator 49 is connected to the eductor 15 via the refrigerant passage 33, and is connected to the refrigerant passage 53 via a refrigerant passage 83. The plate-type heat exchanger 48 heats the low-pressure refrigerant liquid 104 and discharges the low-pressure refrigerant liquid 104 as a refrigerant liquid 141. In this case, a part of the low-pressure refrigerant liquid 104 is evaporated to serve as the refrigerant gas. The gas-liquid separator 49 performs gas-liquid separation on the refrigerant liquid 141 into the refrigerant liquid 104 and a refrigerant gas (refrigerant) 142. The refrigerant liquid 104 is supplied to the eductor 15, and the refrigerant gas 142 is supplied to the compressor 11.

The eductor 15 is connected to the refrigerant supply unit 24 of the evaporator 14 via the refrigerant passage 34, and is connected to the lower portion of the casing 22 via the refrigerant passage 36. The eductor 15 injects, as the refrigerant liquid 105, the low-pressure refrigerant liquid 104 expanded by the second expansion valve 62 to the refrigerant passage 34 side. In this case, the eductor 15 generates the flow speed difference and the pressure difference in the refrigerant liquid 104, and sucks the refrigerant liquid 106 stored in the evaporator 14.

The auxiliary pump 46 supplies the refrigerant liquid 106 stored in the evaporator 14 to the refrigerant passage 34 of the eductor 15. The lower portion of the casing 22 in the evaporator 14 and the refrigerant passage 34 are connected to each other via a refrigerant passage 71. The auxiliary pump 46 is provided in the refrigerant passage 71.

The evaporator 14 is connected to the compressor 11 via the refrigerant passage 35. The evaporator 14 is a liquid film type. The evaporator 14 evaporates the refrigerant liquid 105 including the refrigerant liquid 106 to generate the refrigerant gas 101. A part of the refrigerant liquid 105 is evaporated and supplied as the refrigerant gas 101 to the compressor 41, and the rest serves as the refrigerant liquid 106 stored in the lower portion of the casing 22.

A refrigerating cycle using the chiller 10E is a single-stage refrigerating cycle. The compressor 11 compresses the refrigerant gas 101 from the evaporator 14 to obtain the high-temperature and high-pressure refrigerant gas 102. The condenser 12 condenses the high-temperature and high-pressure refrigerant gas 102 to obtain the refrigerant liquid 103. The expansion valve 13 expands the condensed refrigerant liquid 103 to obtain the low-pressure refrigerant liquid 104. The plate-type heat exchanger 48 heats the refrigerant liquid 104 to obtain the refrigerant liquid 141, and the gas-liquid separator 49 performs gas-liquid separation on the refrigerant liquid 141 into the refrigerant liquid 104 and the refrigerant gas 142. The refrigerant liquid 104 is supplied to the eductor 15, and the refrigerant gas 142 is supplied to the compressor 11. The eductor 15 injects the low-pressure refrigerant liquid 104 toward the evaporator 14, and sucks the refrigerant liquid 106 in the lower portion of the evaporator 14. In addition, the auxiliary pump 46 is operated as necessary, and supplies the refrigerant liquid 106 stored in the evaporator 14 to the refrigerant passage 34. That is, by the eductor 15 and the auxiliary pump 46, the refrigerant liquid 106 stored in the evaporator 14 is supplied to the evaporator 14 together with the refrigerant liquid 104 expanded by the expansion valve 13. The evaporator 14 evaporates a part of the refrigerant liquid 105 to generate the refrigerant gas 101, and supplies the refrigerant gas 101 to the compressor 11. In addition, in the evaporator 14, the unevaporated refrigerant liquid 106 is stored in the lower portion of the casing 22, but is returned to the refrigerant supply unit 24 by the eductor 15 and the auxiliary pump 46.

Actions and Effects of Present Embodiment

The chiller includes the compressors 11 and 41 that compress the refrigerant, the condenser 12 that condenses the refrigerant compressed by the compressors 11 and 41, the expansion valves (expanders) 13, 42, and 44 that expand the refrigerant condensed by the condenser 12, the liquid film type evaporator 14 that evaporates the refrigerant expanded by the expansion valves 13, 42, and 44, and the eductor 15 that uses the pressure difference between the inlet and the outlet to suck the refrigerant stored in the evaporator 14.

In the chiller according to a first aspect, the compressor 11 compresses the refrigerant, the condenser 12 condenses the refrigerant, the expansion valve 13 expands the refrigerant, and the liquid film type evaporator 14 evaporates the refrigerant. In this case, the eductor 15 uses the pressure difference between the inlet and the outlet to suck the refrigerant stored in the evaporator 14, and supplies the refrigerant to the evaporator 14. That is, it is possible to circulate the refrigerant in the evaporator 14 by using a part of the pressure loss in the expansion valve 13 as the operating power of the eductor 15. Therefore, it is not necessary to use a separate pump and the like, and it is possible to suppress the increase in the size and the increase in the cost of the apparatus.

In the chiller according to a second aspect, the compressor 41 is the multi-stage compressor, the expansion valve 42 includes the first expansion valve 54 and the second expansion valve 55 that are disposed in series with the refrigerant passages (discharge passages) 32, 56, and 57 of the refrigerant condensed by the condenser 12, and the economizer (first gas-liquid separator) 43 that supplies the refrigerant gas, which is obtained by gas-liquid separation from the refrigerant, to second and subsequent stages of the compressor 41 is provided between the first expansion valve 54 and the second expansion valve 55. As a result, the efficiency of the two-stage compression two-stage expansion refrigerating cycle can be improved, and the increase in the size and the increase in the cost of the apparatus can be suppressed.

In the chiller according to a third aspect, the compressor 41 is the multi-stage compressor, the expansion valve 44 includes the first expansion valve 61 and the second expansion valve 62 that are disposed in parallel to the refrigerant passages (discharge passages) 63 and 64 of the refrigerant condensed by the condenser 12, and the economizer (first heat exchanger) 45 that exchanges heat between the refrigerant liquid (first refrigerant) 121 after being expanded by the first expansion valve 61 and the refrigerant liquid (second refrigerant) 103 before being expanded by the second expansion valve 62 to supply the refrigerant gas (first refrigerant) 122 to second and subsequent stages of the compressor 41 is provided. As a result, the efficiency of the two-stage compression one-stage expansion refrigerating cycle can be improved, and the increase in the size and the increase in the cost of the apparatus can be suppressed.

In the chiller according to a fourth aspect, the auxiliary pump 46 that supplies the refrigerant stored in the evaporator 14 to the refrigerant passage (discharge passage) 65 of the eductor 15 is provided. As a result, by operating the auxiliary pump 46 as necessary, it is possible to appropriately circulate the refrigerant in the evaporator 14 regardless of an operating state of the chiller.

In the chiller according to a fifth aspect, the bubble pump 47 is provided as the auxiliary pump. As a result, for example, by using the refrigerant compressed by the compressors 11 and 41 to operate the bubble pump 47, the necessity of the electric motor and the like as the driving source of the auxiliary pump can be eliminated, the simplification of the apparatus can be achieved, and an operation cost can be reduced.

In the chiller according to the fourth and fifth aspects, the control device that controls the operations of the auxiliary pump 46 and the bubble pump 47 according to the storage amount of the refrigerant stored in the evaporator 14 is provided. As a result, it is possible to appropriately circulate the refrigerant in the evaporator 14 regardless of the operating state of the chiller.

In the chiller according to a sixth aspect, the plate-type heat exchanger (second heat exchanger) 48 that evaporates the refrigerant expanded by the expansion valve 13 and the gas-liquid separator (second gas-liquid separator) 49 that supplies the refrigerant, which is obtained by gas-liquid separation from the refrigerant heat-exchanged by the plate-type heat exchanger 48, to the compressor 11 are provided. As a result, the function of evaporating the refrigerant is distributed to the evaporator 14 and the plate-type heat exchanger 48, so that the reduction in the sizes of the evaporator 14 and the plate-type heat exchanger 48 can be achieved, a usage amount of the refrigerant used in the evaporator 14 can be reduced, and an increase in the operation cost can be suppressed.

REFERENCE SIGNS LIST

10, 10A, 10B, 10C, 10D, 10E: Chiller
11, 41: Compressor
12: Condenser
13, 42, 44: Expansion valve
14: Evaporator
15: Eductor
21: Electric motor
22: Casing
23: Heat transfer tube
24: Refrigerant supply unit
25: Refrigerant discharge unit
31, 32, 33, 34, 35, 36, 53, 56, 57, 58, 63, 64, 65, 71, 72, 74, 81, 82, 83: Refrigerant passage
43: Economizer (first gas-liquid separator)
45: Economizer (first heat exchanger)
46: Auxiliary pump
47: Bubble pump (auxiliary pump)
48: Plate-type heat exchanger (second heat exchanger)
49: Gas-liquid separator (second gas-liquid separator)
51: First compressor
52: Second compressor
54, 61: First expansion valve (first expander)
55, 62: Second expansion valve (second expander)
73, 75: Opening-closing valve
101, 102, 113, 122, 142: Refrigerant gas (refrigerant)
103, 104, 105, 106, 111, 112, 121, 123, 141, 141: Refrigerant liquid (refrigerant)

The invention claimed is:

1. A chiller comprising:

a compressor that compresses a refrigerant;

a condenser that condenses the refrigerant compressed by the compressor;

an expander that expands the refrigerant condensed by the condenser;

a liquid film evaporator that evaporates the refrigerant expanded by the expander;

an eductor that uses a pressure difference between an inlet and an outlet to suck the refrigerant stored in the evaporator, an auxiliary pump that supplies the refrigerant stored in the evaporator to a discharge passage of the eductor is provided, and a control device that controls an operation of the auxiliary pump according to a storage amount of the refrigerant stored in the evaporator is provided;

wherein the control device operates the auxiliary pump in a case in which the storage amount of the refrigerant liquid of the liquid film evaporator is preset and exceeds the upper storage amount, and stops the operation of the auxiliary pump in a case in which the storage amount of the refrigerant liquid of the liquid film evaporator falls below a preset lower limit storage amount.

2. The chiller according to claim 1, wherein the compressor is a multi-stage compressor, the expander includes a first expander and a second expander that are disposed in series with a discharge passage of the refrigerant condensed by the condenser, and a first gas-liquid separator that supplies a refrigerant gas, which is obtained by gas-liquid separation from the refrigerant, to second and subsequent stages of the compressor is provided between the first expander and the second expander.

3. The chiller according to claim 1, wherein the compressor is a multi-stage compressor, the expander includes a first expander and a second expander that are disposed in parallel to a discharge passage of the refrigerant condensed by the condenser, and a first heat exchanger that exchanges heat between a first refrigerant after being expanded by the first expander and a second refrigerant before being expanded by the second expander to supply the first refrigerant to second and subsequent stages of the compressor is provided.

4. The chiller according to claim 1, wherein the auxiliary pump is a bubble pump.

5. The chiller according to claim 1, wherein a heat exchanger that evaporates the refrigerant expanded by the expander and a gas-liquid separator that supplies a refrigerant gas, which is obtained by gas-liquid separation from the refrigerant heat-exchanged by the heat exchanger, to the compressor are provided.

6. The chiller according to claim 3, wherein a second heat exchanger that evaporates the refrigerant expanded by the expander and a gas-liquid separator that supplies a refrigerant gas, which is obtained by gas-liquid separation from the refrigerant heat-exchanged by the second heat exchanger, to the compressor are provided.

7. The chiller according to claim 1, wherein a heat exchanger that evaporates the refrigerant expanded by the expander and a gas-liquid separator that supplies a refrigerant gas, which is obtained by gas-liquid separation from the refrigerant heat-exchanged by the heat exchanger, to the compressor are provided.

8. The chiller according to claim 4, wherein a heat exchanger that evaporates the refrigerant expanded by the expander and a gas-liquid separator that supplies a refrigerant gas, which is obtained by gas-liquid separation from the refrigerant heat-exchanged by the heat exchanger, to the compressor are provided.

9. The chiller according to claim 1, wherein a heat exchanger that evaporates the refrigerant expanded by the expander and a gas-liquid separator that supplies a refrigerant gas, which is obtained by gas-liquid separation from the refrigerant heat-exchanged by the heat exchanger, to the compressor are provided.

* * * * *